US008449003B2

(12) United States Patent
Bunker, II et al.

(10) Patent No.: US 8,449,003 B2
(45) Date of Patent: May 28, 2013

(54) DOOR EXPANSION ADJUSTING HANDLE AND LATCH SET

(75) Inventors: Owen Woodruff Bunker, II, Denver, CO (US); Tam Le, Santa Ana, CA (US)

(73) Assignee: S.P.E.P. Acquisition Corp., Rancho Dominguez, CA (US)

( * ) Notice: Subject to any disclaimer, the term of this patent is extended or adjusted under 35 U.S.C. 154(b) by 142 days.

(21) Appl. No.: 12/841,966

(22) Filed: Jul. 22, 2010

(65) Prior Publication Data

US 2012/0019013 A1 Jan. 26, 2012

(51) Int. Cl.
*E05B 3/00* (2006.01)
*E05B 1/00* (2006.01)
*E05C 19/00* (2006.01)

(52) U.S. Cl.
USPC ..... 292/336.3; 292/1; 292/347; 292/348

(58) Field of Classification Search
CPC ..... E05B 65/006; E05B 85/06
USPC ..... 292/1, 336.3, 347, 348, 350, DIG. 60
See application file for complete search history.

(56) References Cited

U.S. PATENT DOCUMENTS

| | | | | |
|---|---|---|---|---|
| 2,098,868 | A * | 11/1937 | Grimmond | 292/353 |
| 2,242,866 | A * | 5/1941 | Kozlovskis | 292/350 |
| 2,352,015 | A * | 6/1944 | Sasgen | 292/275 |
| 3,695,664 | A | 10/1972 | Nolin | |
| 4,437,695 | A | 3/1984 | Foshee | |
| 5,046,772 | A | 9/1991 | Su | |
| 5,083,823 | A | 1/1992 | Fann et al. | |
| 5,688,005 | A | 11/1997 | Ellis | |
| 5,816,086 | A | 10/1998 | Russell, IV | |
| 6,174,005 | B1 * | 1/2001 | Norton | 292/169.21 |
| D442,467 | S | 5/2001 | Alvarado | |
| D444,694 | S | 7/2001 | Alvarado | |
| 6,302,453 | B1 | 10/2001 | Norton | |
| 6,357,270 | B1 * | 3/2002 | Vazquez | 70/472 |
| 6,619,710 | B1 * | 9/2003 | Hwang | 292/336.3 |
| 6,868,704 | B2 * | 3/2005 | Simon et al. | 70/215 |
| 6,916,053 | B2 | 7/2005 | Lin | |
| 7,188,873 | B2 | 3/2007 | Brown et al. | |
| D585,721 | S | 2/2009 | Le et al. | |
| 7,523,971 | B2 | 4/2009 | Ebert | |
| 2003/0056556 | A1 | 3/2003 | Park et al. | |
| 2003/0111848 | A1 * | 6/2003 | Hansen | 292/336.3 |
| 2004/0245788 | A1 * | 12/2004 | Lin | 292/336.3 |
| 2006/0138789 | A1 | 6/2006 | Luling et al. | |
| 2012/0019013 | A1 * | 1/2012 | Bunker et al. | 292/336.3 |

FOREIGN PATENT DOCUMENTS

| | | | |
|---|---|---|---|
| EP | 1 479 855 | A2 | 11/2004 |
| EP | 2 105 554 | A1 | 9/2009 |

* cited by examiner

*Primary Examiner* — Thomas Beach
*Assistant Examiner* — Nathan Cumar
(74) *Attorney, Agent, or Firm* — Karish & Bjorgum

(57) ABSTRACT

A door expansion adjusting handle and latch set for mounting on a door. It includes a first handle positioned on a first side of a door having a thickness, a shaft having two ends with one end fixedly connected to the first handle, a second handle positioned on a second side of the door and connected to the other end of the shaft by a nut, the nut permitting the second handle and shaft to rotate relative to each other but preventing the second handle from being removed from the shaft, a latch that is operated by rotating the first handle and/or the second handle, and a coil spring that is interposed between the fixing member and the second handle to bias the first handle and the second handle towards or away from each other. If the thickness of the door increases or decrease, the coil spring will permit the second handle to move closer or further from to the fixing member to accommodate the increase in door thickness.

11 Claims, 8 Drawing Sheets

DOOR EXPANSION ADJUSTING HANDLE AND LATCH SET

BACKGROUND OF INVENTION

The invention relates to door handle and latch sets, and more particularly to a door expansion adjusting handle and latch set particularly well suited for use in environments wherein the door is subject to swelling in the dimension through which the handle and latch is installed to thereby alleviate interference with the operation of the door handle and latch. For example, doors made of plywood, particle board, or waferboard (also known as oriented strand board (OSB)) can expand in thickness when they get wet, and do not always return to their original thickness after drying out. Expansion can also be due to temperature variations or other forces. While there are materials that resist expansion upon becoming wet, particle board and waferboard are readily available and economical to work with and remain popular with manufacturers of storage sheds, outbuildings, and the like.

In many door lock and latch set designs, a turnable handle is located on the outside of the door and a turnable handle is located on the inside of the door and are joined together by a shaft, and the distance between the handles on the shaft, once set, will not vary. The door can be opened from the inside by turning the inside handle and can likewise be opened from the outside by turning the outside handle (if it is unlocked for locking handles). A problem with current door handle sets is encountered when the door expands due to its material, e.g., waferboard, becoming moist or wet or swelling due to temperature or other factors. Since the distance between the inside handle and the outside handle connected to each other by a common shaft does not vary, rough operation of one or both of the handles can occur since expansion of the thickness of the door can exert abnormal pressure on the parts and cause parts in the door lock and latch set to bind up and become difficult to operate smoothly.

There accordingly remains a need for a door handle and latch set that will not bind up even if the door expands in thickness after the door handle and latch set have been installed.

DETAILED DESCRIPTION

Figure 1:
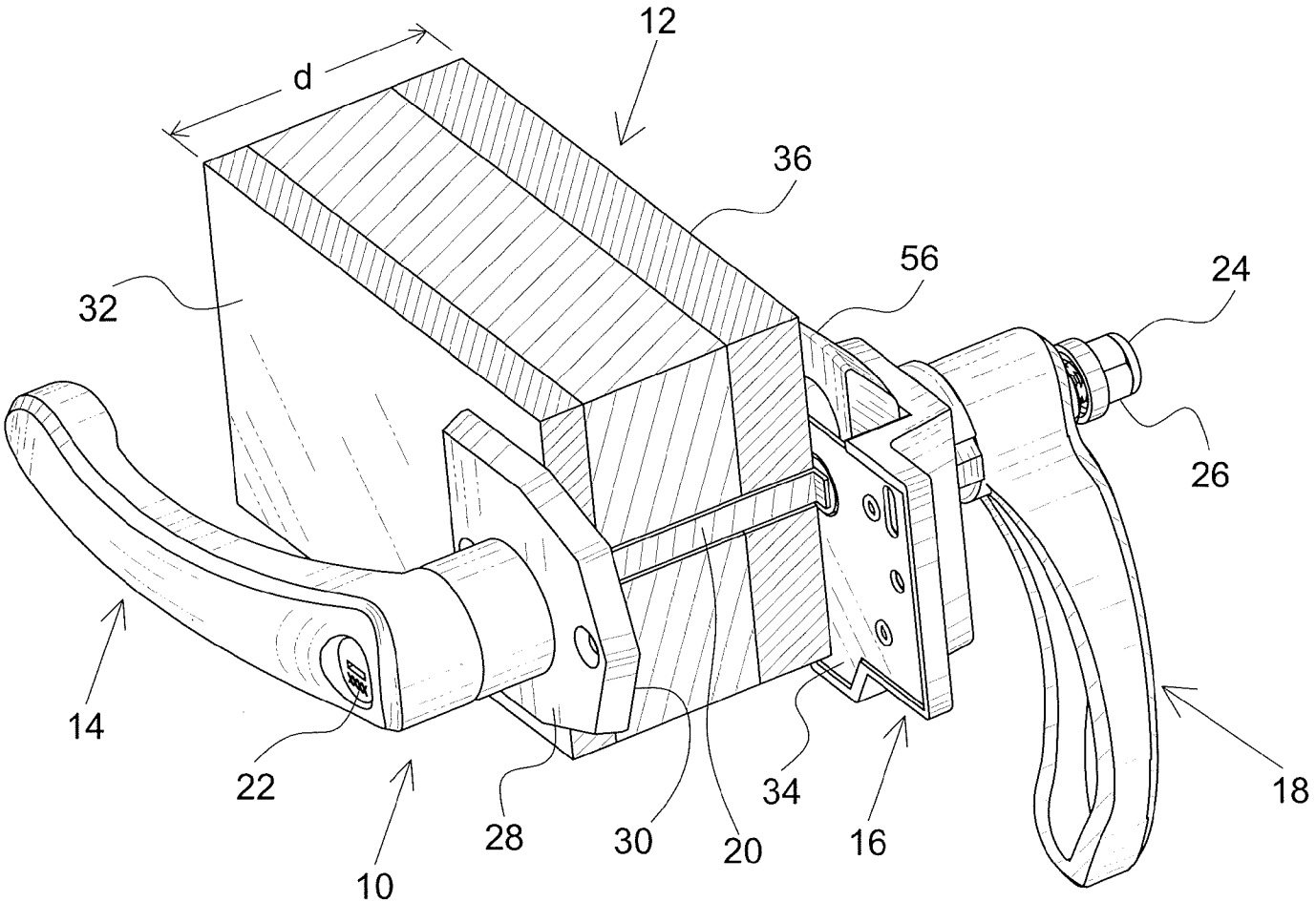
FIG. 1 is a perspective partially exposed view showing an exemplary embodiment of the door expansion adjusting handle and latch set of the invention installed on a door.
Figure 2A:
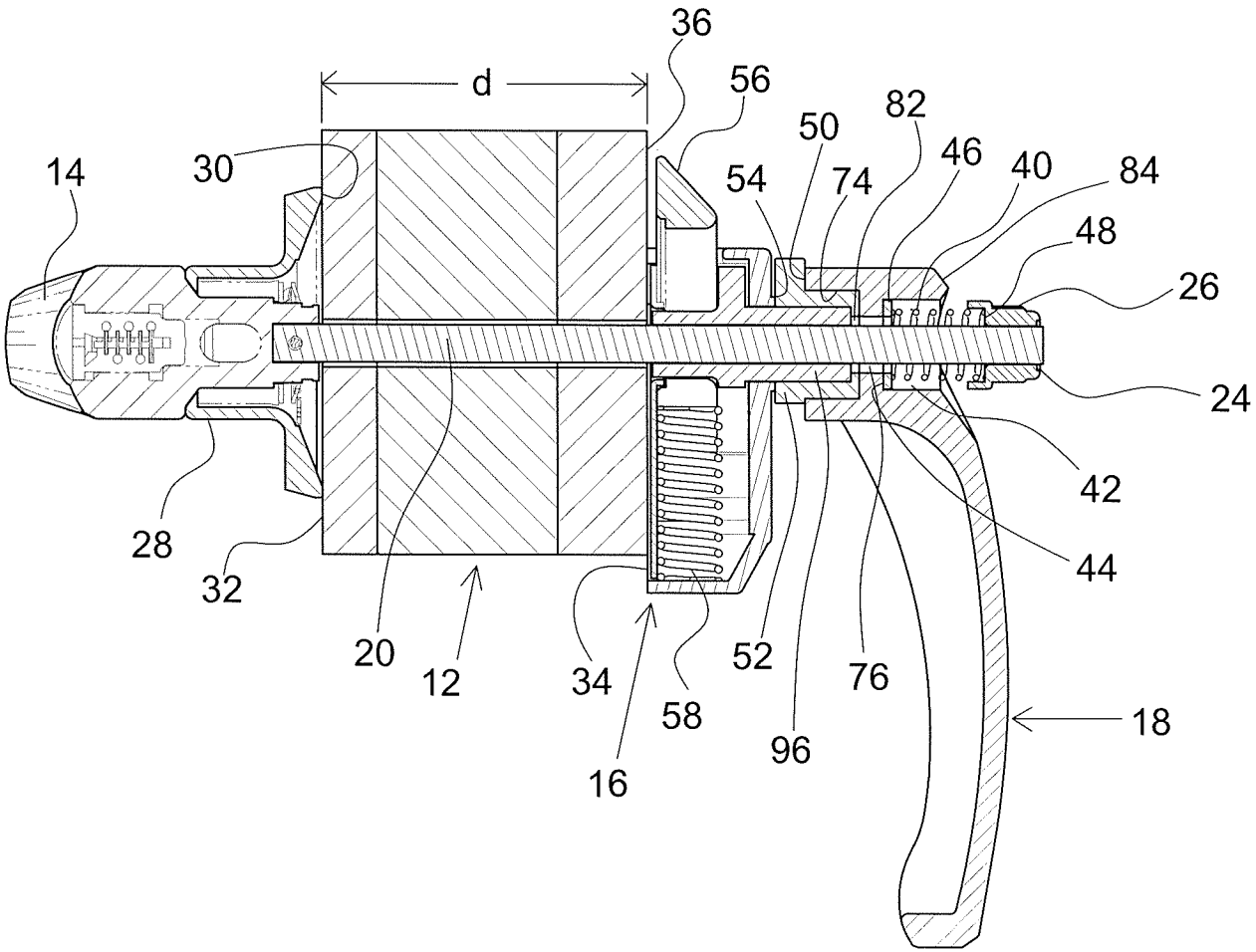
FIG. 2A is a cross-sectional view of the exemplary embodiment of the door expansion adjusting handle and latch set of FIG. 1 installed on a door that has not expanded in thickness.
Figure 2B:
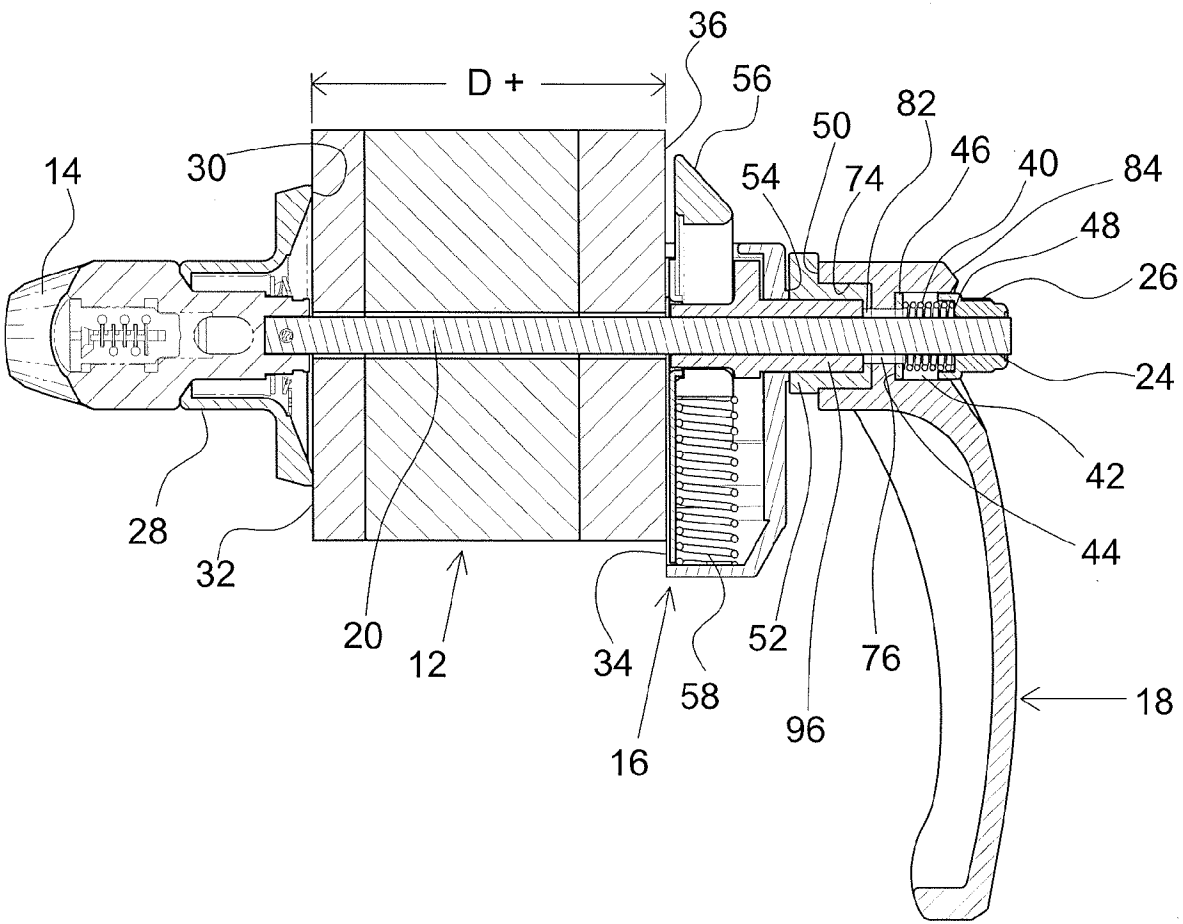
FIG. 2B is a cross-sectional view of the exemplary embodiment of the door expansion adjusting handle and latch set of FIG. 1 installed on a door that has increased in thickness due to swelling or other causes.

FIG. 1 is a perspective partially exposed view showing an exemplary embodiment of the door expansion adjusting handle and latch set 10 of the invention installed on a door 12 having an unswelled thickness "d", and FIG. 2A is a cross sectional view of the exemplary embodiment of the expansion adjusting door handle and latch set 10 of FIG. 1 installed on a door 12 with unexpanded thickness "d". As noted above, in cases where the door is made from materials such as plywood, particle board, and waferboard. The door expansion adjusting handle and latch set 10 includes an exterior door handle 14, a latch 16, an interior door handle 18 and a shaft 20 that joins the exterior door handle 14 and the interior door handle 18. The exterior door handle 14 may include a lock 22. The shaft 20 has a threaded end 24 with a nut 26 to prevent the interior door handle 18 from being moved outwardly on the shaft. The exterior door handle 14 is preferably rotatably connected to an escutcheon 28 which has a back surface 30 which is permanently mounted to the outside 32 of the door 12. The latch 16 has a back surface 34 which is mounted to the inside surface 36 of the door 12. Rotation of the interior door handle 18 does not rotate the shaft 20, whereas the exterior door handle 14 is fixed to the shaft 20 such that when the lock 22 is unlocked, turning the handle 14 will rotate the shaft 20 through the escutcheon 28 and operate the latch 16. In prior art door handle and latch set, which as so far as described appears like the door handle and latch set 10 shown in FIG. 1, once the threaded nut 26 is threaded onto the threaded end 24 of the shaft 20, the distance between back surface 30 of the escutcheon 28 and the back surface 34 of the latch 16, and thus the distance between the exterior door handle 14 and the interior door handle 18 is set and will not adjust to accommodate changes in door thickness "d". As previously discussed, in cases where the door 12 is made of particle board or waferboard, when this door material get wet, the door material can absorb moisture and the door will swell beyond the original thickness "d" when the door handle and latch set 10 was installed, and the door does not always return to its original thickness after drying out, particularly after numerous cycles of becoming wet or moist. Turning to FIG. 2A, the door expansion adjusting handle and latch set 10 of the invention includes a features which accommodates expansion of the door thickness, namely the inclusion of a biasing means, such as coil spring 40 that is placed in an opening 42 having a seat 44 in the top of the door handle 18. A washer 46 can be placed between the seat 44 and the coil spring 40. The coil spring 40 is interposed between seat 44 in the handle 18 and a cup 48 in the bottom of the threaded nut 26, and allows the handle 18 to shift backwardly towards the nut 26 in case the door thickness increases from "d" to "D+" as shown in FIG. 2B. In prior art designs without a coil spring 40, when the door thickness "d" expands too much, the door handle pivot base 50 pushes a cam insert piece 52 against a front surface 54 of the latch 16 and cause binding of the handle 18 and parts thereof. As shown in FIG. 2, the latch 16 includes a catch 56 which biased by a spring 58. As also shown, the shaft 20 is fixed to the exterior handle 14 so that when it is rotated, the shaft 20 will rotate. In contrast, the shaft passes through the interior handle 18 and rotating the shaft, e.g., by rotating the exterior handle 14 does not turn the interior handle 18.

FIG. 2B is a cross-sectional view of the exemplary embodiment of the door expansion adjusting handle and latch set 10 of FIG. 1 installed on a door 12 that has had its thickness increase to thickness "D+" (wherein D+>d). As shown, the coil spring 40 accommodates the increased thickness "D+" by compressing to allow the interior handle 18 to move closer to the nut 26 fixed on the shaft.

Figure 3:
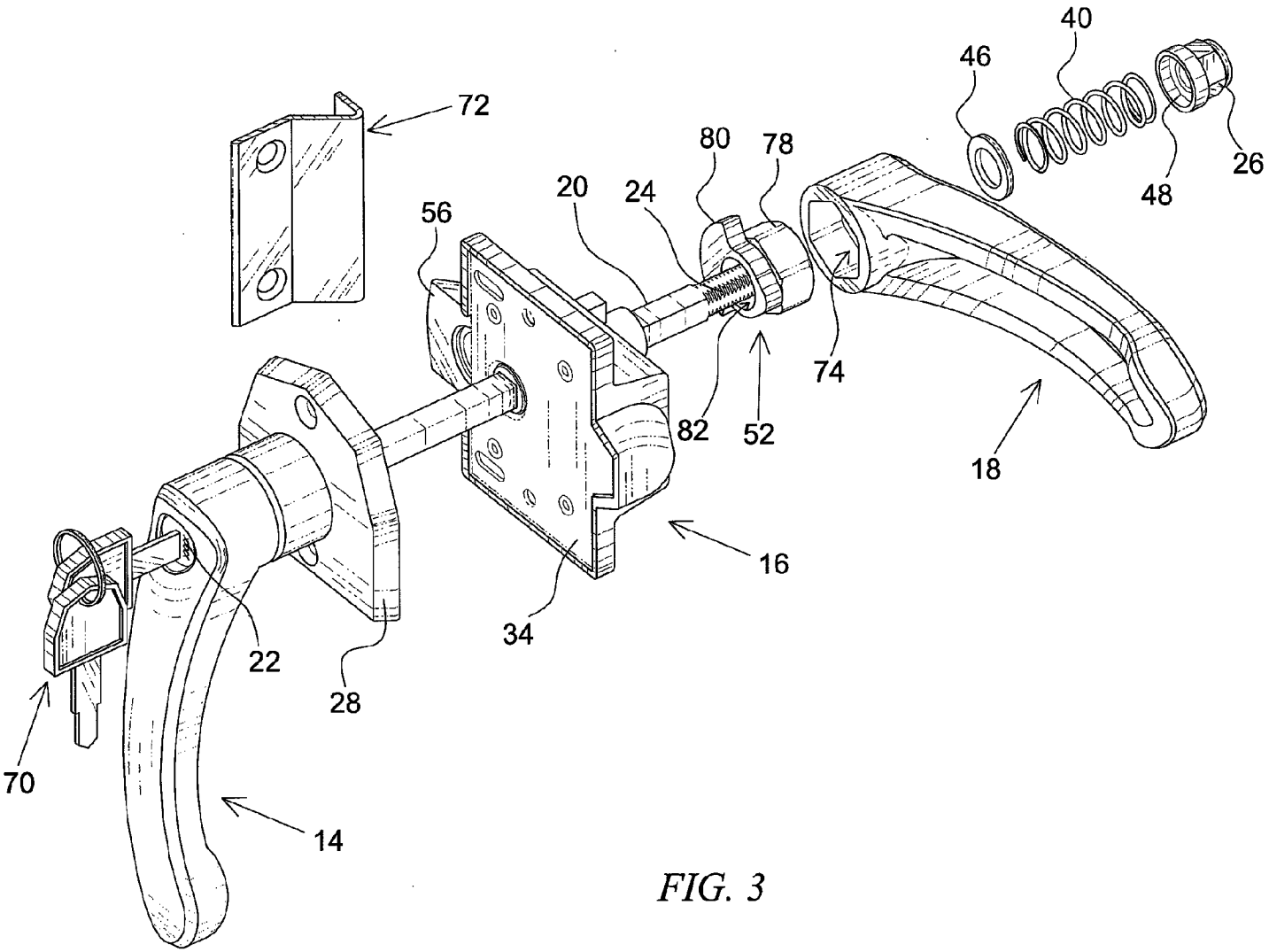
FIG. 3 is an exploded view of the exemplary embodiment of the door expansion adjusting handle and latch set of FIG. 1.

FIG. 3 is an exploded view of the exemplary embodiment of the door expansion adjusting handle and latch set 10 of FIG. 1 and the previously described features are as shown in this figure. Keys 70 are shown in the lock 22 of the exterior handle 14, as is an exemplary striker plate 72 which is to be mounted on a door frame (not shown) to be caught by the catch 56 of the latch 16. Formed in a bottom of the interior handle 18 is the interior handle head hollow 74 (e.g., shown as being generally hexagonal) which is adapted to engage with a complementary hexagonal insert 78 formed on the cam insert piece 52 which is designed to fit into the interior handle head hollow 74 of the interior handle 18. Also shown is a through hole 76 which passes through the handle 18. The cam insert piece 52 has a cam section 80. A through hole 82 is formed through the cam insert piece 52 through which the shaft 20 freely extends. Thus, turning the interior handle 18 will rotate the cam insert piece 52 independently of any rotation of the shaft 20. As will be explained below with reference to FIGS. 9 and 10, the cam section 80 will act on the protrusions 100 of the latch 16 and cause the catch 56 to be withdrawn back into the latch 16 when the interior handle 18 is rotated.

Figure 5:
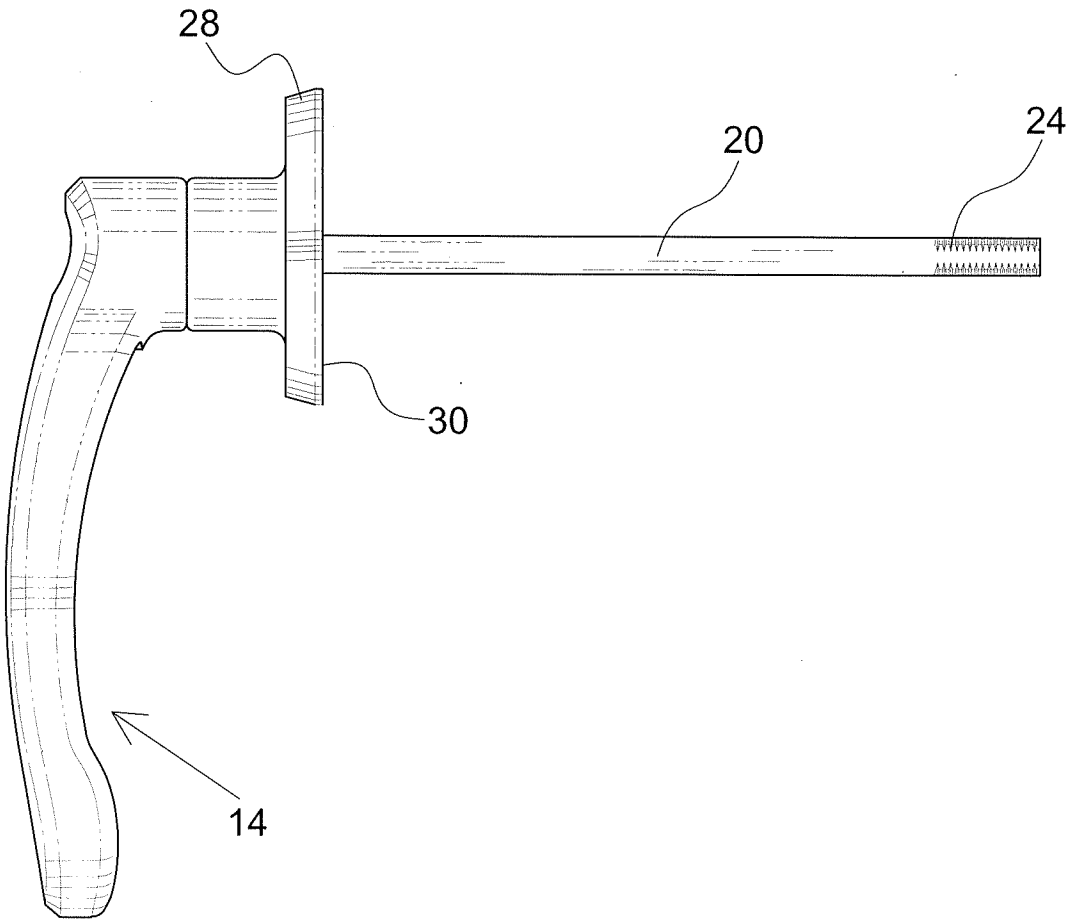
FIG. 5 is a side view of the exterior handle and its connected escutcheon of FIG. 5 connected to a shaft.
Figure 4:
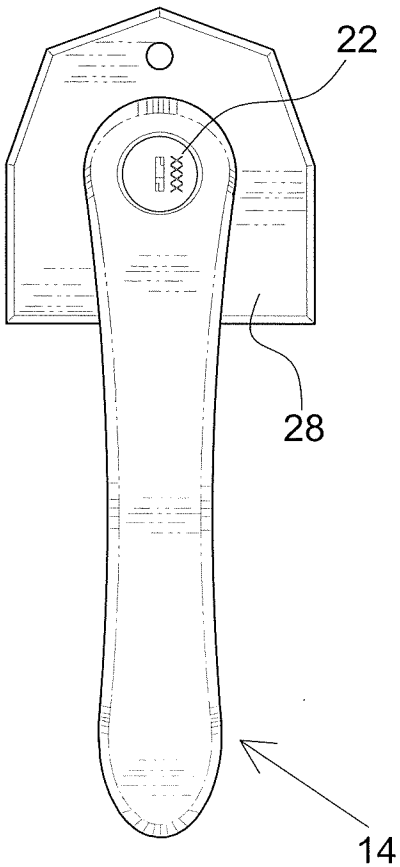
FIG. 4 is a front view of the exterior handle and its connected escutcheon of the exemplary door expansion adjusting handle and latch set of FIG. 1.

FIG. 4 is a front view and FIG. 5 is a side view of the exterior handle 14 and its connected escutcheon 28 of the exemplary expansion adjusting door handle and latch set 10 of FIG. 1. The lock 22 and shaft 20 with a threaded end 24 and bottom 30 of escutcheon 28 are shown.

Figure 8:
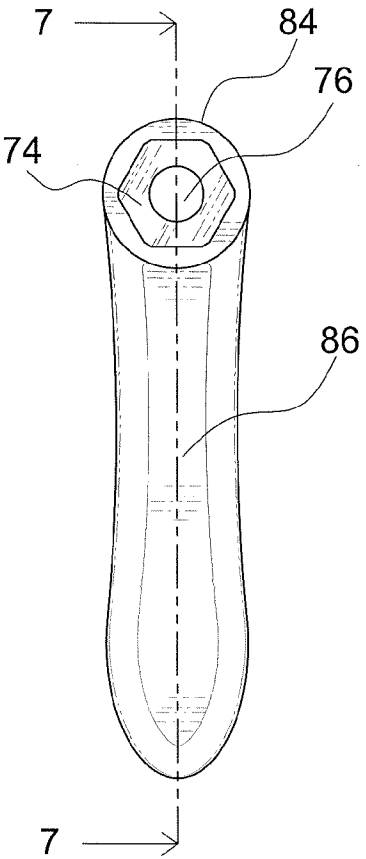
FIG. 8 is a back view of the interior handle of FIG. 6.
Figure 7:
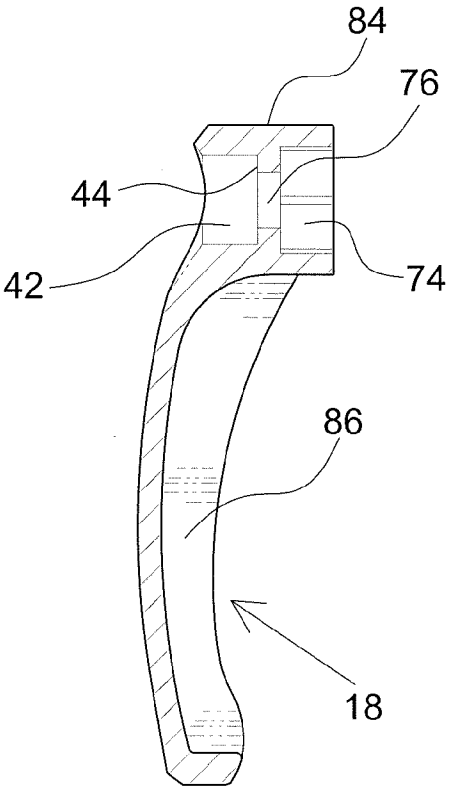
FIG. 7 is a cross-sectional view of the interior handle of FIG. 6.
Figure 6:
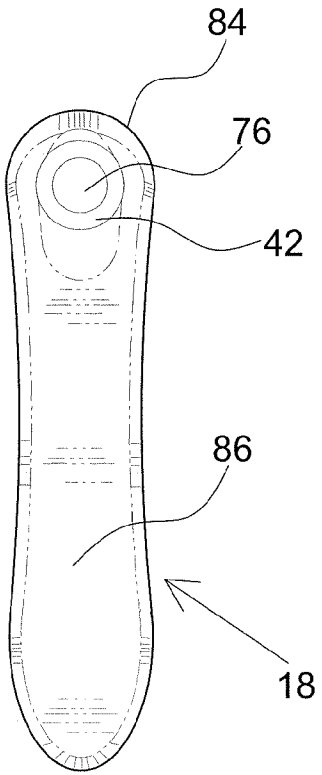
FIG. 6. is a front view of an interior handle of the exemplary door expansion adjusting handle and latch set of FIG. 1.

FIG. 6 is a front view, FIG. 7 is a cross-sectional view, and FIG. 8 is a back view of an interior handle 18 of the exemplary door expansion adjusting handle and latch set 10 of FIG. 1. The interior handle 18 has a head region 84 and a grasping region 86. The head region 84 has the interior handle head hollow 74 formed therein which is sized and shaped to receive and turn the complementary hexagonal insert 78 formed on the cam insert piece 52 (shown in FIGS. 2 and 3). The through hole 76, through which the shaft 20 (shown in FIG. 2) will freely pass is also shown. The opening 42 having a seat 44 is shown in the head region 84 and is adapted to receive the coil spring 40 and a lower end of the nut 26, as shown in FIGS. 2A, 2B, and 3.

Figure 11:
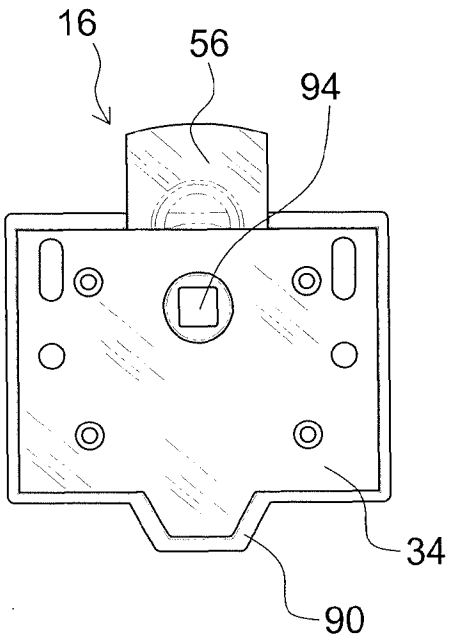
FIG. 11 is a back view of the latch of FIG. 9.
Figure 10:
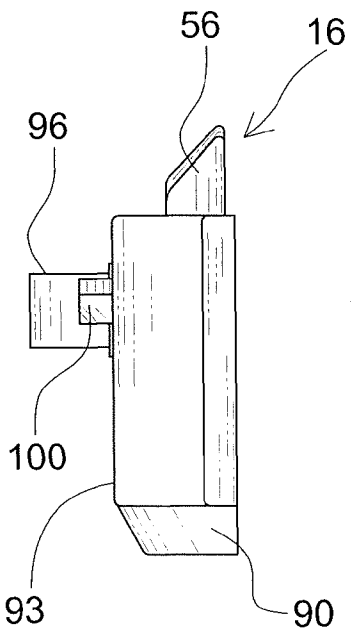
FIG. 10 is a side view of the latch of FIG. 9.
Figure 9:
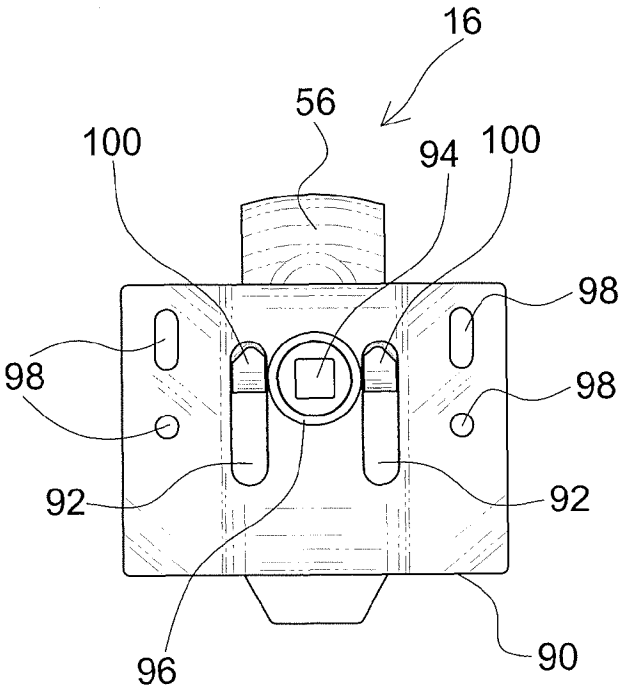
FIG. 9 is a front view of a latch of the exemplary door expansion adjusting handle and latch set of FIG. 1.

FIG. 9 is a front view, FIG. 10 is a side view, and FIG. 11 is a back view of a latch 16 of the exemplary door expansion adjusting handle and latch set 10 of FIG. 1. The latch 16 has a catch 56 that protrudes from a latch body 90. Slots 92 are formed through a front surface 93, through which protrude protrusions 100 of the latch 16. The protrusions are spring loaded by spring 58 (shown in FIGS. 2A and 2*b*) and when either protrusion 100 is pushed away from the protruding catch 56, the catch 56 will be drawn into the latch body 90. The protrusions 100 are moved by contact with the cam section 80 of the cam insert piece 52 (shown in FIGS. 14-17). A shaft engagement 94 (e.g., having a cross-sectional opening that is complementary to and through which the shaft can slide through) is rotatable by the shaft (when the shaft is rotated by operating the exterior handle 14) and moves the catch 56 back into the latch body 90. Extending from the front surface 93 of the latch 16 is a cam insert ring 96 in the form of a cylindrical ring onto which the cam insert 52 rotatably fits (as shown in FIGS. 2A and 2B). Screw mounting holes 98 are formed through the latch 16.

Figure 13:
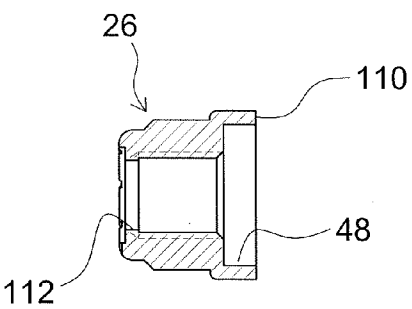
FIG. 13 is a cross-sectional view of the lock nut of FIG. 12.
Figure 12:
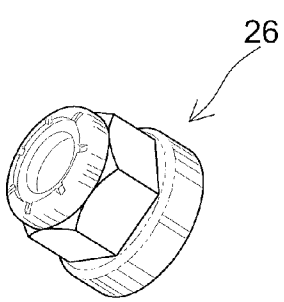
FIG. 12 is a perspective view of a lock nut of the exemplary door expansion adjusting handle and latch set of FIG. 1.

FIG. 12 is a perspective view and FIG. 13 is a cross-sectional view of a lock nut 26 of the exemplary door expansion adjusting handle and latch set 10 of FIG. 1. Formed in a back end 110 is a cup 48 that is sized to receive an end of the spring 40 as shown in FIGS. 2A and 2B. The diameter of the back end 110 is sized to fit into the opening 42 shown in the head region 84 of FIGS. 2A and 2B. The lock nut is threaded 112 to be securely fixed to the threaded end 24 of the shaft 20.

Figure 14:
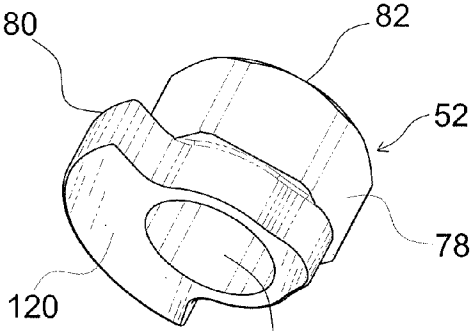
FIG. 14 is a perspective view of a cam insert of the exemplary door expansion adjusting handle and latch set of FIG. 1.
Figure 17:
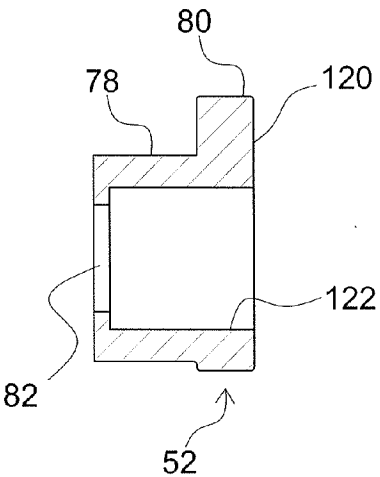
FIG. 17 is a cross-sectional view of the cam insert through view lines 17-17 of FIG. 16.
Figure 16:
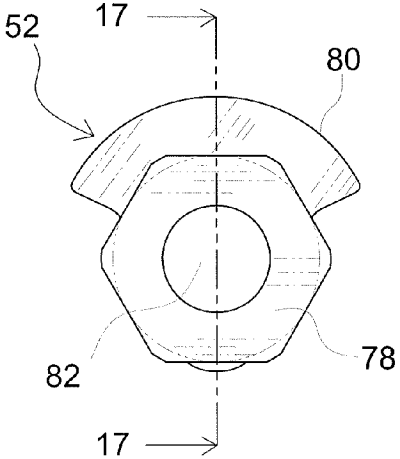
FIG. 16 is a rear view of the cam insert of FIG. 14.
Figure 15:
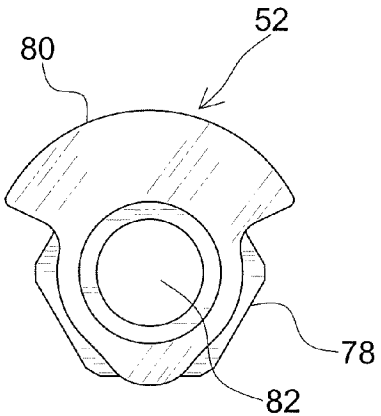
FIG. 15 is a front view of the cam insert of FIG. 14.

FIG. 14 is a perspective view of a cam insert 52 of the exemplary door expansion adjusting handle and latch set 10 of FIG. 1, and FIG. 15 is a front view, FIG. 16 is a rear view, and FIG. 17 is a cross-sectional view of the cam insert 52. The cam insert piece 52 has a hexagonal insert 78 and a cam section 80. A circular through hole 82 is formed through the cam insert piece 52 through which the shaft 20 freely extends and can rotate relative thereto without causing the cam insert 52 to rotate. Also formed in through a face 120 is a cylindrical cavity 122 which is sized to rotatably receive the cam insert ring 96.

While the exterior and interior handle distance expansion features has been described with the particular door expansion adjusting handle and latch set 10 having the exterior handle 14, latch 16, interior handle, and cam insert 52 as shown, in fact, the feature including a biased handle can be utilized in other designs for door handle and latch sets.

Having thus described the exemplary embodiments of the present invention, it should be understood by those skilled in the art that the above disclosures are exemplary only and that various other alternatives, adaptations, and modifications may be made within the scope of the present invention. The presently disclosed embodiment is to be considered in all respects as illustrative and not restrictive. The scope of the invention being indicated by the appended claims rather than the foregoing description, and all changes which come within the meaning and range of equivalency of the claims are, therefore, intended to be embraced therein.

What is claimed is:

1. A door expansion adjusting handle and latch set for mounting on a door, comprising:

a first handle positioned on a first side of a door having a thickness;

a shaft having two ends, wherein the first handle is fixedly connected to one end of the shaft;

a second handle which is positioned on a second side of the door to the other end of the shaft by a fixing member, the fixing member permitting the second handle and shaft to rotate relative to each other but preventing the second handle from being removed from the shaft; a latch that is operated by rotating the first handle and/or the second handle; and a biasing member that is interposed between the fixing member and the second handle to take up any changes in the thickness of the door and which automatically biases the first handle and the second handle towards each other without any need for a user to make further adjustments of a position of the fixing member on the shaft, wherein if the thickness of the door increases, the biasing member will automatically permit the second handle-to move closer to the fixing member to increase a working length of the shaft between the first and second handles, and if the thickness of the door decreases, the biasing member will automatically permit the second handle to move further from the fixing member to decrease a working length of the shaft between the first and second handles.

2. The door expansion adjusting handle and latch set of claim 1, further comprising an escutcheon to which the first handle rotatably connects, which escutcheon is attached to the first side of the door.

3. The door expansion adjusting handle and latch set of claim 1, wherein the biasing member comprises a coil spring that is positioned on the shaft and is at least partially positioned at a first end in a cavity formed at a front of the second handle, the second handle having a hole passing through the cavity through which the shaft rotatably passes, and wherein the fixing member comprises a nut with a cup to retain a second end of the coil spring.

4. The door expansion adjusting handle and latch set of claim 1, further comprising a cam that is connected to and rotated by the second handle, which cam operates the latch independently of operation of the latch by the first handle turning the shaft which also operates the latch.

5. The door expansion adjusting handle and latch set of claim 4, wherein the cam has a non-round portion which fits into a complementary non-round cavity in a rear of the second handle so that rotation of the second handle rotates the cam and operates the latch.

6. The door expansion adjusting handle and latch set of claim 1, wherein the first handle has a lock that when open, permits the first handle and its attached shaft to operate the latch, but when locked, prevents the first handle from rotating and operating the latch.

7. A door expansion adjusting handle and latch set for mounting on a door, comprising:

a first handle positioned on a first side of a door having a thickness;

a shaft having two ends, wherein the first handle is fixedly connected to one end of the shaft and wherein the second end of the shaft is threaded;

a second handle which is positioned on a second side of the door and is retained to the second end of the shaft by a nut, the nut having a cup and permitting the second handle and shaft to rotate relative to each other but preventing the second handle from being removed from the shaft, the second handle having a cavity formed at a front thereof and having a hole passing through the cavity through which the shaft rotatably passes;

a latch that is operated by rotating the first handle and/or the second handle;

a cam that is connected to and rotated by the second handle, which cam operates the latch independently of operation of the latch by the first handle turning the shaft which also operates the latch; and a coil spring that is positioned on the shaft between the cup of the nut and in the cavity of the second handle to take up any changes in the thickness of the door and which coil spring automatically biases the first handle and the second handle towards each other without any need for a user to make further adjustments of a position of the nut on the shaft, wherein if the thickness of the door increases or decreases, the biasing member coil spring will automatically compress or expand as necessary to change a working length of the shaft between the first and second handles and to permit the second handle to move closer or farther from the fixing member to accommodate the increase or decrease in door thickness.

8. The door expansion adjusting handle and latch set of claim 7, further comprising an escutcheon to which the first handle rotatably connects, which escutcheon is attached to the first side of the door.

9. The door expansion adjusting handle and latch set of claim 7, wherein the cup of the nut retains a second end of the coil spring.

10. The door expansion adjusting handle and latch set of claim 7, wherein the cam has a non-round portion which fits into a complementary non-round cavity in a rear of the second handle so that rotation of the second handle rotates the cam and operates the latch.

11. The door expansion adjusting handle and latch set of claim 7, wherein the first handle has a lock that when open, permits the first handle and its attached shaft to operate the latch, but when locked, prevents the first handle from rotating and operating the latch.

* * * * *